US008747103B2

(12) United States Patent
Glidden

(10) Patent No.: US 8,747,103 B2
(45) Date of Patent: Jun. 10, 2014

(54) OVEN BURNER FLAME SENSING APPARATUS

(76) Inventor: James A. Glidden, Suttons Bay, MI (US)

( * ) Notice: Subject to any disclaimer, the term of this patent is extended or adjusted under 35 U.S.C. 154(b) by 423 days.

(21) Appl. No.: 12/573,068

(22) Filed: Oct. 2, 2009

(65) Prior Publication Data

US 2010/0196834 A1 Aug. 5, 2010

Related U.S. Application Data

(60) Provisional application No. 61/195,114, filed on Oct. 3, 2008.

(51) Int. Cl.
*F23N 5/00* (2006.01)

(52) U.S. Cl.
USPC ..... 431/71; 431/78

(58) Field of Classification Search
USPC ..... 431/71, 78
See application file for complete search history.

(56) References Cited

U.S. PATENT DOCUMENTS

| | | | | |
|---|---|---|---|---|
| 2,698,655 | A * | 1/1955 | Meredith | 431/13 |
| 3,100,521 | A * | 8/1963 | Deubel | 431/24 |
| 3,520,645 | A * | 7/1970 | Cotton et al. | 431/78 |
| 3,647,196 | A * | 3/1972 | Cotton | 432/37 |
| 3,697,229 | A * | 10/1972 | Frey et al. | 422/114 |
| 4,454,827 | A * | 6/1984 | Smith et al. | 110/234 |
| 5,073,104 | A * | 12/1991 | Kemlo | 431/12 |
| 5,102,328 | A * | 4/1992 | Robinson | 431/116 |
| 5,195,885 | A * | 3/1993 | Medina | 431/25 |
| 5,391,075 | A * | 2/1995 | Robinson et al. | 431/258 |
| 5,527,180 | A * | 6/1996 | Robinson et al. | 431/258 |
| 5,791,890 | A * | 8/1998 | Maughan | 431/6 |
| 5,927,961 | A * | 7/1999 | Robinson et al. | 431/207 |
| 6,030,205 | A * | 2/2000 | Maughan | 431/29 |
| 6,059,562 | A * | 5/2000 | Anderson, II | 431/80 |
| 6,085,738 | A * | 7/2000 | Robinson et al. | 126/75 |
| 6,216,683 | B1 * | 4/2001 | Maughan | 126/19 R |
| 6,808,389 | B1 * | 10/2004 | Glidden | 431/264 |
| 7,044,729 | B2 * | 5/2006 | Ayastuy et al. | 431/25 |
| 2001/0049079 | A1 * | 12/2001 | Robinson et al. | 431/207 |
| 2006/0199122 | A1 * | 9/2006 | Matteson et al. | 431/75 |

* cited by examiner

*Primary Examiner* — Kenneth Rinehart
*Assistant Examiner* — Gajanan M Prabhu
(74) *Attorney, Agent, or Firm* — Robert L. Farris; Farris Law, P.C.

(57) ABSTRACT

Apparatus for sensing the presence of a flame issuing from the flow of fuel through an elongate oven burner comprises an electrical current sensor immersed in a flame having carbon atoms which support such current. The fuel is ignited by a spark igniter. Should no flame exist after a predetermined time interval, or if the flame is extinguished, the supply of fuel to such burner is terminated and the spark igniter is disabled.

8 Claims, 3 Drawing Sheets

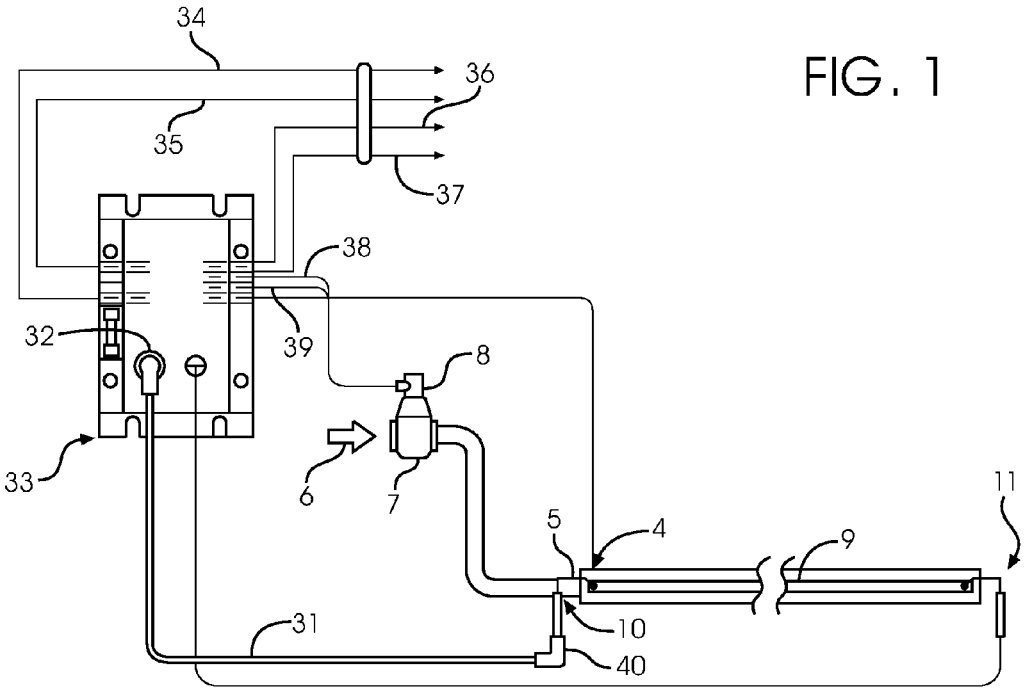
FIG. 1
FIG. 4
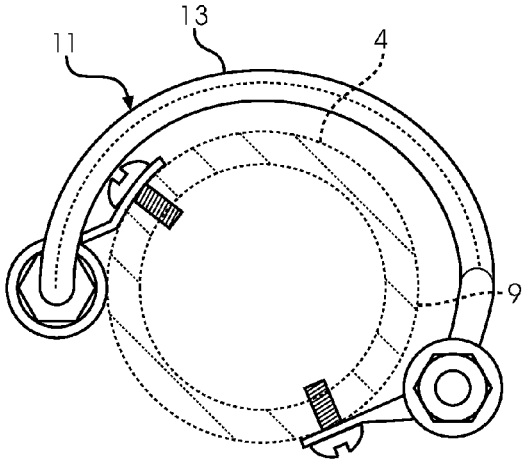

OVEN BURNER FLAME SENSING APPARATUS

PRIOR APPLICATION

This application is a continuation of and claims the benefit of the filing date of U.S. Provisional Application No. 61/195,114, filed Oct. 3, 2008.

This invention relates to apparatus for sensing the presence of a flame at that end of an oven burner tube which is remote from that end of such tube to which combustible fuel is introduced.

BACKGROUND OF THE INVENTION

A typical commercial bakery oven has a housing within which are mounted a plurality of burner tubes that extend from one side of the housing to the opposite side. Such an oven conventionally has one or more movable product conveyors which convey goods that are to be baked along a path from one end of the oven to the other. At intervals along the length of the oven are burners which extend transversely of the path of movement of the goods to be baked. Conventionally, each burner comprises a hollow tube having an outlet slot along one side thereof through which flows a combustible fuel, such as gas. At one end of each tube is a source of fuel and an igniter by means of which the fuel is ignited as it flows outwardly through the slot of the burner tube wall.

Each burner tube conventionally extends from one side of the oven toward the opposite side and has a length of ten to twelve feet, or more. It is conventional to ignite the fuel at that end of the burner tube which is adjacent one wall of the oven so that, during start up operation, a continuous flame is generated in a direction from the igniter to the opposite end of the tube which terminates adjacent that wall of the oven which is remote from the wall through which the burner tube extends. A finite period of time is required for the flame to be propagated from the igniter end of the tube to the remote end thereof at which the presence of a flame may be sensed by a conventional flame sensor. When the flame is sensed, operation of the igniter terminates. In some instances, however, and for one reason or another a flame does not extend all the way from the igniter end of the burner tube to the remote end. This is undesirable because unburned fuel is discharged to the interior of the oven and the heating of the oven is not as efficient or as effective as it should be. Accordingly, it is desirable to be able to sense the presence of a flame at such remote end of each burner tube.

A principal object of the invention is to provide apparatus for sensing the presence of the flame at the remote end of the burner.

SUMMARY OF THE INVENTION

A burner tube adapted for inclusion in a commercial baking oven is mounted at one side of the oven in a position to receive a combustible fuel and combustion air which passes through a slot extending longitudinally of the tube from one end to the other. Adjacent the fuel inlet end of the burner tube is a fuel igniter which typically is of the spark ignition type, i.e., one which generates sparks adjacent the fuel outlet slot so as to ignite the fuel as it passes through such slot. At that end of the burner tube remote from the fuel inlet end is mounted a flame sensor which is operable to sense the presence of flame and generate an electrical signal which is delivered to the igniter to terminate operation thereof. The sensor is mounted in such position as to be immersed in the flame when it exists and is coupled to a conductor which extends alongside the burner tube toward the igniter so as to complete an electrical circuit to the latter for discontinuing the operation of the igniter when the sensor senses the presence of flame. The igniter is of conventional construction and is operable to generate sparks which ignite fuel issuing from the burner tube and becomes disabled in response to the generation of a current which flows partially through the flame to the flame sensor which is electrically coupled to the igniter in such manner as to discontinue operation of the igniter when the presence of the flame is detected.

THE DRAWINGS

Apparatus constructed in accordance with the invention is illustrated in the accompanying drawings wherein:

FIG. 1 is a schematic diagram illustrating the component parts of the apparatus;

FIG. 4 is an enlarged sectional view taken on the line 4-4 of FIG. 2.

THE PREFERRED EMBODIMENT

Apparatus constructed in accordance with the presently preferred embodiment is adapted for use with an oven having a wall 1 at one side thereof and a similar wall (not shown) at the opposite side and which parallels the wall 1. The oven has a top (not shown) as is conventional and a bottom (not shown) as also is conventional. The walls of the oven define a chamber through which products to be baked are conveyed along a substantially horizontal path extending from one end of the oven to the other. The end walls of the oven have appropriate means (not shown) for enabling products to be introduced to and removed from the oven.

At longitudinally spaced intervals along the length of the oven is a plurality of openings 2 in the side wall 1. Each opening is spanned by a mounting plate 3 through which an elongate burner tube 4 extends in direction from the wall 1 toward the opposite wall. The burner tubes are formed of electrically conductive material and extend transversely of the path of travel of the goods traversing the oven during the baking process. Adjacent burner tubes are spaced apart from one another an appropriate distance longitudinally of the oven so as to enable the interior of the oven to be heated to and maintained at an appropriate temperature for the baking of a particular product.

Figure 2:
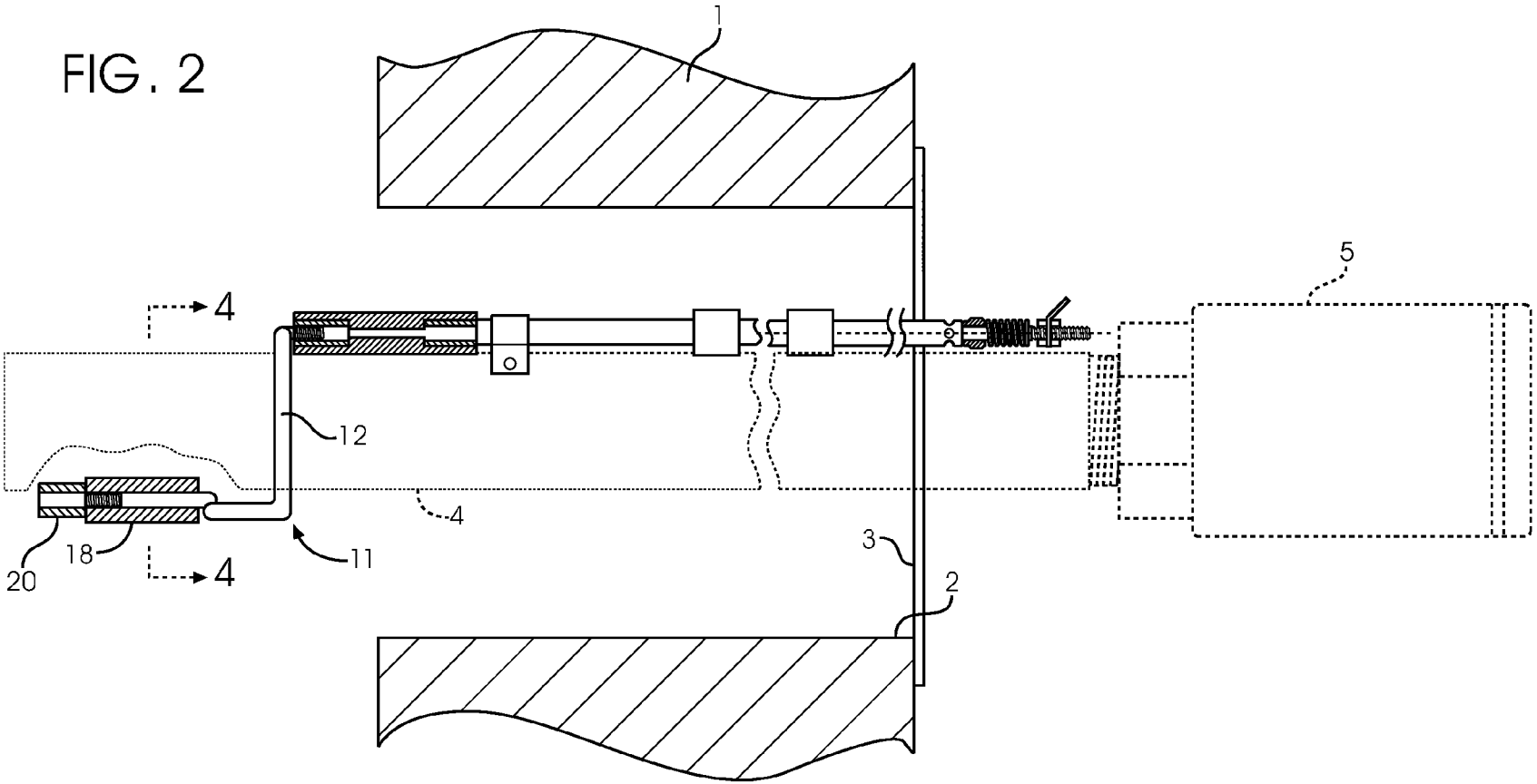
FIG. 2 is an enlarged assembly view of the apparatus and its relationship to the oven and the burner therein.
Figure 3:
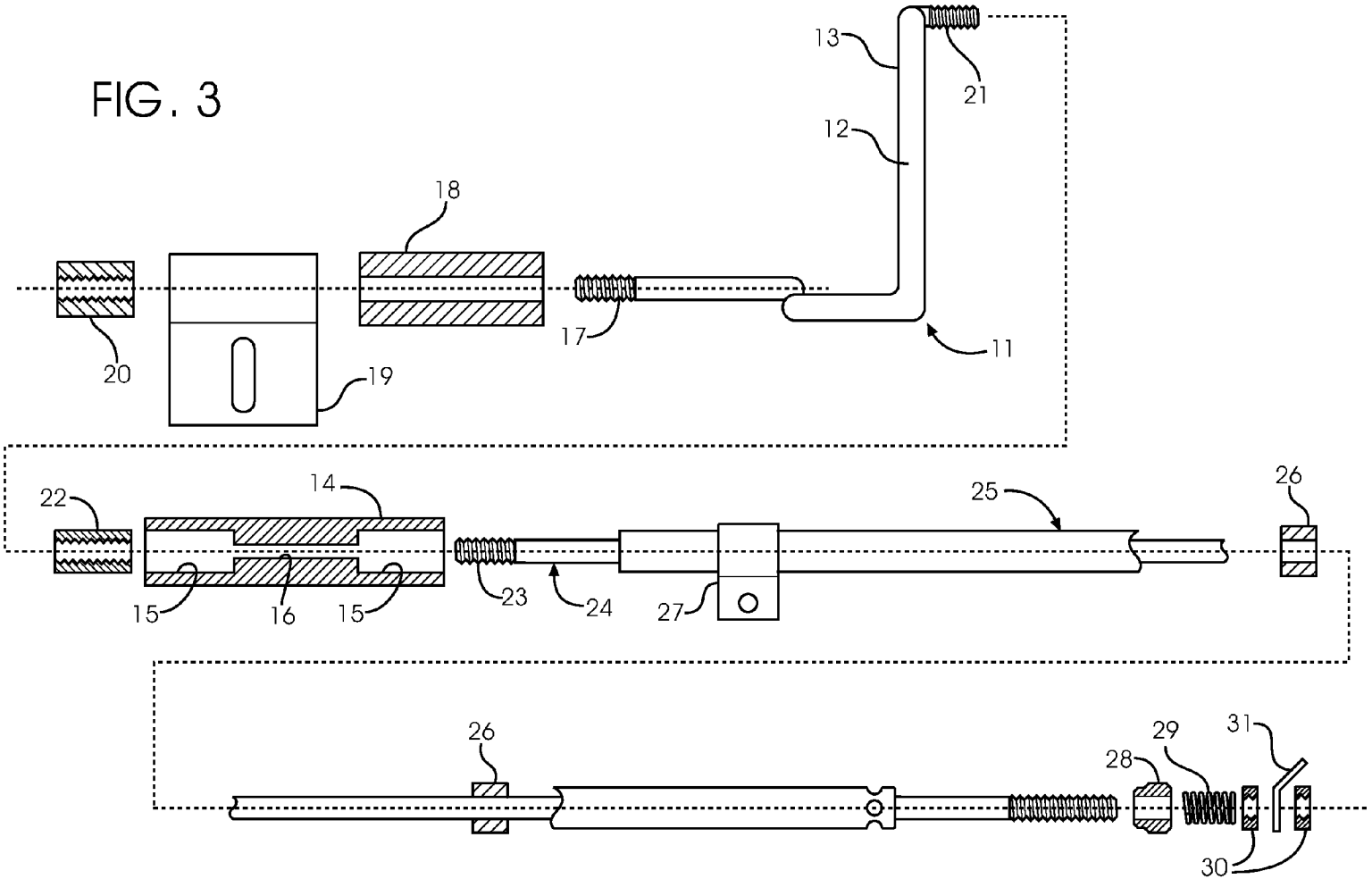
FIG. 3 is an exploded view of the parts of the apparatus illustrated in FIG. 2.

As is indicated at FIG. 2, one end of the burner tube 2 projects outwardly of and beyond the wall 1 and is coupled to a fitting 5 for the reception of a combustible fuel and combustion air form a source thereof indicated by the arrow 6 in FIG. 1 under the control of a valve 7 which opens and closes in response to operation of a solenoid 8, as is conventional. The tube 4 has an elongate outlet or slot 9 through which fuel may pass into the oven.

Adjacent that end of the burner tube near the oven wall 1, and within the oven, is mounted a spark igniter 10 of known construction which, when energized, is operable to initiate a plurality of sparks. The igniter 10 is so located as to enable the sparks to ignite fuel discharged through the outlet 9 of the burner tube 4. The igniter may be of the kind disclosed in U.S. Pat. No. 6,808,389.

At the opposite end of the burner tube 4, i.e., that end of the tube remote from the igniter 10, is a sensor 11. The sensor comprises an electrically conductive member 12 having one part thereof spaced from and confronting the fuel slot 9 so as to occupy a position immersed in the flame caused by the burning fuel when there is such a flame. The sensor has an arcuate mounting section 13 which is formed on a radius larger than, but having the same center as, that of the tube 4. One end of the sensor is accommodated in an electrically insulating coupling 14. The coupling is of tubular form and has a socket 15 at each end thereof, the two sockets being in communication with a passage 16. The other free end 17 of the sensor is threaded and is accommodated in an insulating support 18 which is mounted within a support clasp 19 which may be screwed or otherwise secured to the exterior of the burner tube 4. A coupling nut 20 is threaded onto the threaded end 17 of the sensor so as to avoid relative sliding movement between the sensor end 17 and the insulator 18.

The opposite end 21 of the sensor 13 is threaded and accommodated in a coupling nut 22 which, in turn, is accommodated in the socket 15 at one end of the insulated coupling 14. The opposite socket 15 accommodates a threaded end 23 of an electrical conductor 24 which extends through a tube 25. The end of the conductor 24 extends not only through the socket 15 at the adjacent end of the coupling 14, but also through the passage 16 for threaded connection to the coupling nut 22.

The conductor 24 also extends through ceramic or other non-conductive supports 26 which are accommodated in the tube 25 and prevent contact between the conductor 24 and the tube even in those instances in which the tube deforms due to heat within the oven. At longitudinally spaced intervals are straps 27 by means of which the tube 25 is secured to the burner tube 4 so as to parallel the latter.

One end of the tube 25 passes through the opening 2 in the oven wall 1 and is provided with fittings 28 and 29 by means of which the conductor 24 is fixed within the tube 25 and to an electrically conductive lead 31 which is coupled to an appropriate terminal 32 of a control module 33 such as that manufactured and sold by Honeywell and designated S87D1012. Other terminals of the module 33 are connected by wiring 34 and 35 to a source of electrical energy. Other wiring 36 and 37 are connected to indicators, such as those indicative of a burner's being on or off. The circuit of which the conductor 31 and the igniter 10 are parts includes a relay 40 which enables and disables energy to be supplied from the module 33 to the igniter.

The control module 33 is connected by wiring 38 to the solenoid 8 of the fuel valve 7. An additional conductor 39 is connected to the fuel delivery apparatus so as to place the burner tube 4 at ground potential.

In operation, the fuel valve 7 is opened so that combustion air and fuel may enter and flow through the burner tube 4. At an appropriate time, the igniter 10 may be actuated so that the electrode 5 generates sparks to ignite fuel passing outwardly from the burner tube through the slot 9. Once fuel is ignited it will burn progressively throughout the length of the slot 9 so that, after the passage of several seconds, a flame will be established from one end of the slot to the other. When the flame is established at that end of the burner tube which is remote from the fuel inlet end thereof, the carbon atoms in the flame will enable an electrical circuit to be completed from the sensor 11 to the control module 33 and actuate the relay 40 so as to discontinue sparking of the igniter. The igniter will be inactive as long as an electrical current exists through the flame issuing through the burner tube slot 9. Should there be a failure to establish and maintain the flame, the circuit from the sensor 11 to the solenoids 8 and 40 will be interrupted, thereby disabling the igniter 10 and closing the fuel valve 7. The igniter conventionally includes a timer (not shown) which is operable to disconnect the igniter from its electrical energy source if a flame is not sensed after a certain time period. The apparatus thus not only establishes a circuit for controlling the operation of the igniter, but also monitors the system to ensure the presence of flame at the burner.

The disclosed embodiment is representative of a presently preferred form of the invention, but is intended to be illustrative rather than definitive thereof. The invention is defined in the claims.

I claim:

1. An oven burner and a flame sensing apparatus comprising;

an elongate burner tube with a first end extending through a mounting plate adjacent an opening through a first oven side wall, a fitting for the reception of combustible fuel and combustion air attached to the first end of the elongate burner tube, an elongate outlet slot in the elongate burner tube, through which combustible fuel and combustion air may pass, and the elongate outlet slot extending from a slot end position near the first oven side wall toward an opposite end of the elongate burner tube in an oven chamber;

the flame sensing apparatus including an electrically conductive sensor member with a threaded free end, a threaded opposite end, and an arcuate mounting section integral with the threaded free end and the threaded opposite end;

an insulating support mounted on the threaded free end, a first coupling nut screwed to the threaded free end and holding the insulating support on the electrically conductive sensor member, a support clasp secured to the insulating support, attached to the elongate burner tube and holding the first coupling nut adjacent to and spaced from the elongate outlet slot in a position in which the first coupling nut will be positioned in flames when the oven burner is in operation;

a second coupling nut screwed to the threaded opposite end of the electrically conductive sensor member and received in a first socket in an electrically insulating coupling having a second socket and a passage extending between the first socket and the second socket;

an electrical conductor having a first conductor threaded end and a second conductor threaded end, the first conductor threaded end passing through the second socket and the passage extending between the first socket and the second socket and screwed into the second coupling nut thereby connecting the electrical conductor to the electrically conductive sensor member;

a plurality of non-conductive supports telescopically received on the electrical conductor, a tube extending over the non-conductive supports, having a tube first end received in the second socket in the electrically insulating coupling and a tube second end extending through the first oven side wall;

at least one strap secured to the tube extending over the non-conductive supports, attached to the elongate burner tube and holding the arcuate mounting section of the electrically conductive sensor member out of engagement with the elongate burner tube;

an insulator fitting mounted on the second conductor threaded end and engaging the tube second end to hold the second conductor threaded end out of engagement with the tube second end, a resilient fitting received on the second conductor threaded end and engaging the insulator fitting, a first conductor threaded nut screwed onto the second conductor threaded end and engaging the resilient fitting, an electrically conductive lead received on the second conductor threaded end, and a second conductor threaded nut screwed onto the second conductor threaded end and holding the electrically conductive lead in engagement with the first conductor threaded nut.

2. An oven burner and flame sensing apparatus, as set forth in claim 1, wherein the at least one strap secured to the tube extending over the non-conductive supports includes a second strap secured to the tube extending over the non-conductive supports and attached to the elongate burner tube.

3. An oven burner and flame sensing apparatus, as set forth in claim 1, wherein the arcuate mounting section has an arcuate radius about a center axis of the oven burner that exceeds a burner radius about the center axis of the oven burner.

4. An oven burner and flame sensing apparatus, as set forth in claim 1, wherein the arcuate mounting section of the electrically conductive sensor member positions the threaded opposite end of the electrically conductive sensor on an opposite side of the elongate burner tube from the elongate outlet slot.

5. An oven burner and a flame sensing apparatus comprising;

an elongate burner tube with a first end extending through a mounting plate adjacent an opening through a first oven side wall, a fitting for the reception of combustible fuel and combustion air attached to the first end of the elongate burner tube, an elongate outlet slot in the elongate burner tube, through which combustible fuel and combustion air may pass, and the elongate outlet slot extending from a slot end position near the first oven side wall toward an opposite end of the elongate burner tube in an oven chamber;

the flame sensing apparatus including an electrically conductive sensor member with a threaded free end, a threaded opposite end, and an arcuate mounting section integral with the threaded free end and the threaded opposite end;

an insulating support mounted on the threaded free end, a first coupling nut screwed to the threaded free end and holding the insulating support on the electrically conductive sensor member, a support clasp secured to the insulating support, attached to the elongate burner tube and holding the first coupling nut adjacent to and spaced from the elongate outlet slot in a position in which the first coupling nut will be positioned in flames when the oven burner is in operation;

a second coupling nut screwed to the threaded opposite end of the electrically conductive sensor member and received in a first socket in an electrically insulating coupling , the electrically insulating coupling having a second socket and a passage extending between the first socket and the second socket;

an electrical conductor having a first conductor threaded end and a second conductor threaded end, the first conductor threaded end passing through the second socket and the passage extending between the first socket and the second socket and screwed into the second coupling nut thereby connecting the electrical conductor to the electrically conductive sensor member;

a plurality of non-conductive supports telescopically received on the electrical conductor, a tube extending over the non-conductive supports, having a tube first end received in the second socket in the electrically insulating coupling and a tube second end extending through the first oven side wall;

at least one strap secured to the tube extending over the non-conductive supports, attached to the elongate burner tube and holding the arcuate mounting section of the electrically conductive sensor member out of engagement with the elongate burner tube;

an insulator fitting mounted on the second conductor threaded end and engaging the tube second end to hold the second conductor threaded end out of engagement with the tube second end, a resilient fitting received on the second conductor threaded end and engaging the insulator fitting, a first conductor threaded nut screwed onto the second conductor threaded end and engaging the resilient fitting, an electrically conductive lead received on the second conductor threaded end, and a second conductor threaded nut screwed onto the second conductor threaded end and holding the electrically conductive lead in engagement with the first conductor threaded nut; and wherein the arcuate mounting section of the electrically conductive sensor member positions the threaded opposite end of the electrically conductive sensor on an opposite side of the elongate burner tube from the elongate outlet slot.

6. An oven burner and a flame sensing apparatus comprising;

an electrically conductive elongate burner tube with a first end extending through a mounting plate adjacent an opening through a first oven side wall, a fitting for the reception of combustible fuel and combustion air attached to the first end of the elongate burner tube, an elongate outlet slot in the elongate burner tube, through which combustible fuel and combustion air may pass, and the elongate outlet slot extending from a slot end position near the first oven side wall toward an opposite end of the electrically conductive elongate burner tube in a conveyor oven chamber;

the flame sensing apparatus including an electrically conductive sensor member with a threaded free end, a threaded opposite end, and an arcuate mounting section integral with the threaded free end and the threaded opposite end;

an insulating support mounted on the threaded free end, a first coupling nut screwed to the threaded free end and holding the insulating support on the electrically conductive sensor member, a support clasp secured to the insulating support, attached to the elongate burner tube and holding the first coupling nut adjacent to and spaced from the elongate outlet slot in a position in which the first coupling nut will be positioned in flames when the oven burner is in operation;

a second coupling nut screwed to the threaded opposite end of the electrically conductive sensor member and received in a first socket in an electrically insulating coupling having a second socket and a passage extending between the first socket and the second socket;

an electrical conductor having a first conductor threaded end and a second conductor threaded end, the first conductor threaded end passing through the second socket and the passage extending between the first socket and the second socket and screwed into the second coupling nut thereby connecting the electrical conductor to the electrically conductive sensor member;

a plurality of non-conductive supports telescopically received on the electrical conductor, a tube extending over the non-conductive supports, having a tube first end received in the second socket in the electrically insulating coupling and a tube second end extending through the first oven side wall;

at least one strap secured to the tube extending over the non-conductive supports, attached to the elongate burner tube and holding the arcuate mounting section of the electrically conductive sensor member out of engagement with the elongate burner tube;

an insulator fitting mounted on the second conductor threaded end and engaging the tube second end to hold the second conductor threaded end out of engagement with the tube second end, a resilient fitting received on the second conductor threaded end and engaging the insulator fitting, a first conductor threaded nut screwed onto the second conductor threaded end and engaging the resilient fitting, an electrically conductive lead received on the second conductor threaded end; and wherein the arcuate mounting section of the electrically conductive sensor member positions the threaded opposite end of the electrically conductive sensor on an opposite side of the electrically conductive elongate burner tube from the elongate outlet slot.

7. An oven burner and flame sensing apparatus, as set forth in claim 6, including a second strap secured to the tube extending over the non-conducting supports and attached to the electrically conductive elongate burner tube.

8. An oven burner and flame sensing apparatus, as set forth in claim 6, wherein the arcuate mounting section has an arcuate radius about a center axis of the electrically conductive elongate burner tube that exceeds the length of a burner radius about the center axis.

* * * * *